US005422609A

United States Patent [19]

Ho et al.

[11] Patent Number: 5,422,609

[45] Date of Patent: Jun. 6, 1995

[54] UNIPLANAR MICROSTRIP TO SLOTLINE TRANSITION

[75] Inventors: Thinh Q. Ho, Anaheim; Stephen M. Hart, San Diego, both of Calif.

[73] Assignee: The United States of America as represented by the Secretary of the Navy, Washington, D.C.

[21] Appl. No.: 261,620

[22] Filed: Jun. 17, 1994

[51] Int. Cl.[6] ..... H01P 5/10

[52] U.S. Cl. ..... 333/26; 333/33

[58] Field of Search ..... 333/21 R, 26, 33

[56] References Cited

U.S. PATENT DOCUMENTS

| | | | |
|---|---|---|---|
| 3,784,933 | 1/1974 | Scherer et al. | 333/26 |
| 3,995,239 | 11/1976 | Head et al. | 333/21 R |
| 4,005,375 | 1/1977 | Pringle et al. | 333/21 R |
| 4,085,391 | 4/1978 | Schiek et al. | 333/33 |
| 4,135,170 | 1/1979 | Baril et al. | 333/26 |
| 4,260,964 | 4/1981 | Saul | 333/26 |
| 4,406,020 | 9/1983 | Reindel . | |
| 4,636,757 | 1/1987 | Harrison et al. . | |
| 4,642,584 | 2/1987 | Funck et al. . | |
| 4,679,249 | 7/1987 | Tanaka et al. . | |
| 4,851,794 | 7/1989 | Williams et al. . | |
| 5,075,647 | 12/1991 | Petter . | |
| 5,278,575 | 1/1994 | Thomas | 333/26 X |
| 5,303,419 | 4/1994 | Ittipiboon et al. . | |

OTHER PUBLICATIONS

U.S. application Ser. No. 08/079,311, filed Jun. 17, 1993, Ho et al.

*Primary Examiner*—Paul Gensler

*Attorney, Agent, or Firm*—Harvey Fendelman; Thomas Glenn Keough; Michael A. Kagan

[57] ABSTRACT

A uniplanar microstrip to slotline transition is provided which includes a substrate having opposed first and second sides. A first electrically conductive layer is joined to the first side of the insulating substrate; and a second electrically conductive layer is joined to the second side of the substrate. The second layer is configured to provide a microstrip, a microstrip transmission mode to slotline transmission mode transition having a matching element, and a slotline.

12 Claims, 4 Drawing Sheets

UNIPLANAR MICROSTRIP TO SLOTLINE TRANSITION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to the field of microwave integrated circuits, and more particularly to a device for achieving conversion of a microstrip transmission line mode ("microstrip") to a slot transmission line ("slotline") mode with transmission lines existing on one side of a substrate.

Microwave integrated technology includes devices such as a microstrip and a slotline. A microstrip is an unbalanced, wideband transmission line which is easily manufactured, and generally comprises a thin conductor layer on one surface of an insulating substrate, generally formed by well known printed circuit techniques, and a wider ground plane conductor joined to the opposite side of the insulating substrate. A slotline is a balanced transmission line and generally comprises a slot formed between electrically conductive coatings formed on an insulating substrate. In the operation of a slotline, there is generally a voltage difference between the edges of the slot. The voltage difference generates an electric field which extends across the slot and a magnetic field which is perpendicular to the electric field. Because the voltage difference extends across the slot, a slotline is especially convenient for connecting shunt elements such as diodes, resistors, and capacitors across the slot.

Devices for converting radio frequency (RF) energy from a microstrip transmission mode to a slotline transmission mode are well known. With such devices, the microstrip and slotlines are usually located on opposite sides of an insulating substrate. Unfortunately, these devices are not easily implemented in microwave integrated circuits (MIC) or monolithic microwave integrated circuits (MMIC) which require that the circuit be suspended because circuit elements are typically mounted on both sides of the substrate and would otherwise be shorted out.

Therefore, there is a need for a microwave to slotline transition in which the circuit elements are fabricated on one side of a substrate in order to simplify their manufacture and to facilitate their integration into microwave integrated circuits by allowing one side to be grounded to a metal shielding structure.

DESCRIPTION OF THE DRAWINGS

Throughout the several views, like reference numbers refer to like components and features.

SUMMARY OF THE INVENTION

Figure 1:
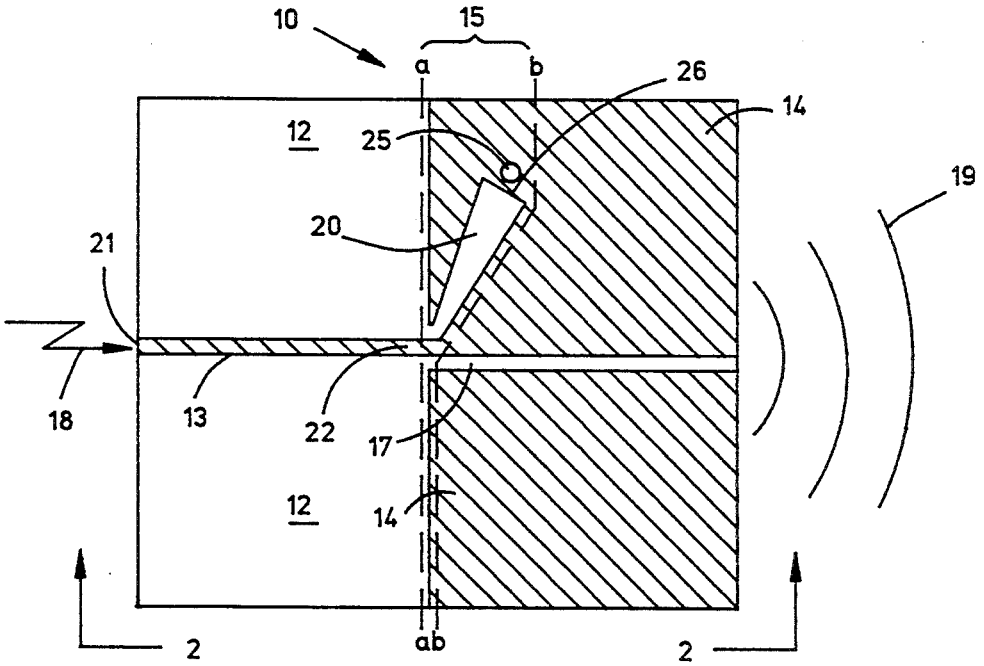
FIG. 1 is a plan view of a uniplanar microstrip to slotline transition embodying various features of the present invention.

The present invention provides a uniplanar microstrip to slotline transition which includes an insulating or semiconducting substrate having opposed first and second sides. A first electrically conductive layer is joined to the first side of the substrate; and a second electrically conductive layer is joined to the second side of the substrate, which forms a ground plane. The first electrically conductive layer is configured to provide a microstrip, a microstrip to slotline transition having a matching element, and a slotline.

An example of one application of the present invention provides a shielded microstrip to slotline transition comprising a metal housing having a first side parallel to a second side which together define a channel, and a uniplanar microstrip to slotline transition mounted within the channel. The uniplanar microstrip to slotline transition includes a substrate having opposed first and second surfaces and is mounted within the channel so that the second surface is substantially adjacent to and coterminous with respect to the second side to form a ground plane. The substrate is composed of a material selected from the group consisting of electrically insulating materials and semiconducting materials. An electrically conductive layer is joined to the first surface of the substrate and configured to provide a microstrip, a microstrip to slotline transition having a matching element, and a slotline in electrical contact with the housing. The substrate is positioned within the channel so as to form an air gap between the electrically conductive layer and the first side of the housing.

Another example of an application of the present invention provides a microstrip to waveguide transition which comprises a metal housing having a first side parallel to a second side which together define a channel and a uniplanar microstrip to slotline transition mounted in the channel. The transition includes a substrate having opposed first and second surfaces which is mounted within the channel. The substrate is composed of a material selected from the group consisting of electrically insulating materials and semiconducting materials. A first electrically conductive layer is joined to the first surface of the substrate; and a second electrically conductive layer is joined to the second surface of the substrate. The second electrically conductive layer is configured to provide a microstrip, a microstrip transmission mode to slotline transmission mode transition having a matching element, and a slotline which is in electrical contact with the housing. The substrate is mounted within the channel so that a first air gap is formed between the first electrically conductive layer and the first side of the housing, and a second air gap is formed between the second electrically conductive layer and the second side of the housing.

An advantage of the present invention is that it provides a microwave to slotline transition in which the circuit elements are fabricated on one side of a substrate.

Another advantage of the invention is that it provides a microstrip to slotline transition which allows direct integration of printed circuit antennas into MIC/MMIC circuits.

These and other advantages will become more readily apparent from the following specification and claims.

DESCRIPTION OF THE PREFERRED EMBODIMENT

Figure 2:
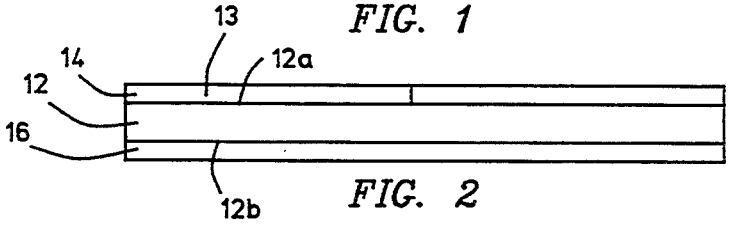
FIG. 2 is a side view of the uniplanar microstrip to slotline transition of FIG. 1 along plane 2—2.

Referring to FIG. 1, there is shown an example of one embodiment of a uniplanar microstrip to slotline transition (hereinafter referred to as "MST") 10 embodying various features of the present invention. MST 10 transforms an unbalanced RF input signal 18 to a balanced RF output signal 19. As shown in FIG. 2, MST 10 is generally formed of a laminated structure formed of a preferably insulating substrate 12 having opposed, preferably planar, surfaces 12*a* and 12*b* sandwiched between electrically conductive and preferably monolithic layers 14 and 16.

In one aspect of the invention, the substrate 12 may be formed of electrically non-conductive, or insulating material such as plastic, ceramic, quartz, or alumina. However, in some applications, the material comprising the substrate 12 may include semiconducting materials from of the group consisting of Group III, Group IV, and Group V semiconductors, such as silicon, gallium arsenide, indium phosphide. In the preferred embodiment, the substrate 12 has a thickness which generally does not exceed about 100 mils, particularly in the microstrip section so that MST 10 does not degrade the performance of the microstrip and/or impede effective radiation of output signal 19 in antenna applications.

By way of example, the electrically conductive layers 14 and 16 may be made of materials which include copper, aluminum, electrically conductive polymer, or a superconductor such as YBaCuO (yttrium barium copper oxide). The layers 14 and 16 may be joined to or formed on the substrate 12, as for example, by using standard integrated circuit manufacturing techniques. The layer 14 is configured to provide a microstrip 13, transition region 15, and slotline 17. The transition region 15 is the area of MST 10 in which the RF signal 18 transitions between a microstrip transmission mode and a slotline transmission mode, and includes the matching element 20 and ground pin 25. By way of example in FIG. 1, the transition region 15 of MST 10 is generally bounded by perimeters a—a and b—b. The frequency response of MST 10 is determined by the shape and size of the matching element 20, as would be well known by those skilled in the art of microwave integrated circuit design.

Figure 5:
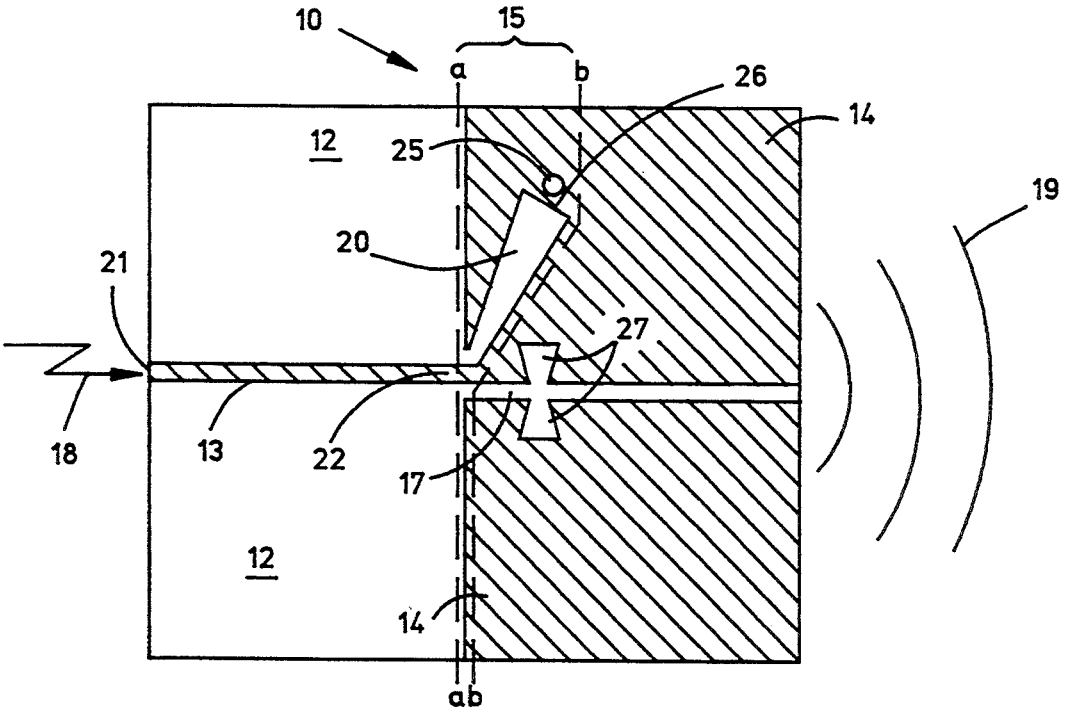
FIG. 5 is a plan view of a uniplanar microstrip to slotline transition embodying various features of the present invention which includes three matching elements.
Figure 9:
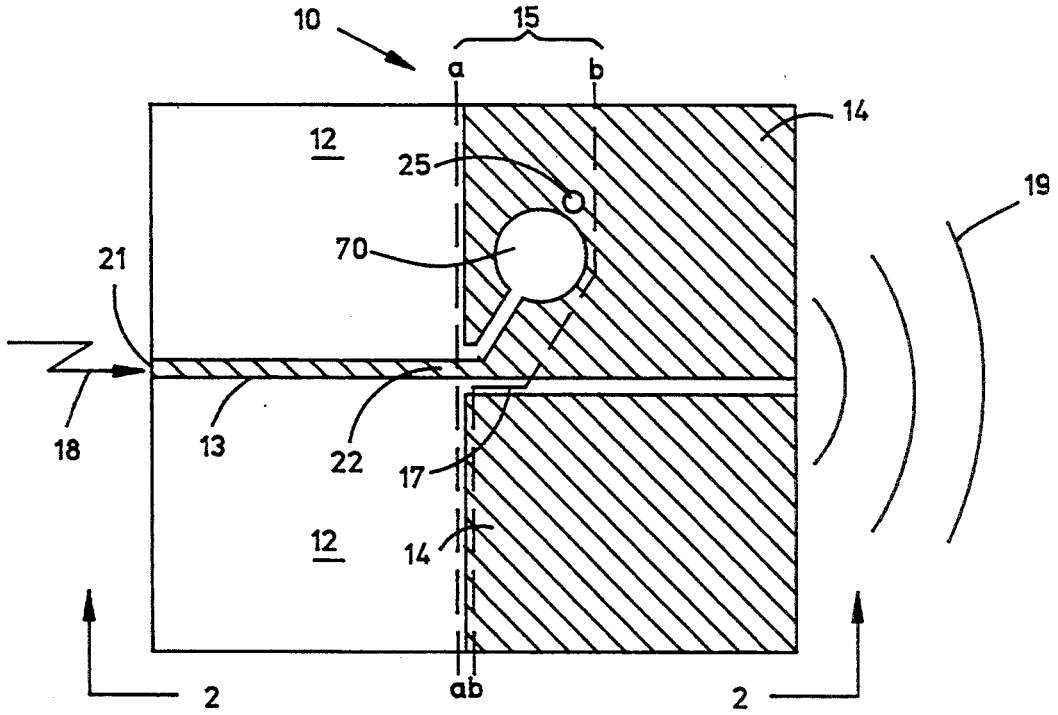
FIG. 9 shows a uniplanar microstrip to slotline transition having a circularly shaped matching element.

The microstrip 13 is a laminated structure comprised of a preferably rectangular and peninsular shaped planar section of layer 14 formed on one side of the underlying substrate 12, and which includes the electrically conductive layer 16 underlying the peninsular section of layer 14. In applications for transforming a microstrip transmission mode to a slotline transmission mode, the microstrip 13 also includes RF input end 21 and RF output end 22. The transition region 15 includes a matching element 20, such as a radial slot, and slotline 17 which receives the RF signal from RF output end 22 of the microstrip 13. The matching element 20 is a "peninsula" shaped region of substrate 12 exposed through electrically conductive layer 14. The shape of the matching element 20 establishes the center frequency and bandwidth of the RF signal 18 detected by MST 10, and may be shaped, by way of example, as a radial slot such as a circle, rectangle, ellipsoid, polygon, triangle, or the like. The matching element 20 and slotline 22 are defined by areas of exposed substrate 12 over which regions of conductive layer 14 have been removed, as for example by etching, bordered by remaining regions of electrically conductive layer 14. By way of example, matching element 20, shown in FIGS. 1 and 5, and matching element 27, shown in FIG. 5, are triangularly shaped. A circularly shaped matching element 70 is shown in FIG. 9.

It is hypothesized that in the operation of MST 10, the unbalanced RF signal 18 propagates along the length of the microstrip 13, its electric field is rotated 90° with respect to the direction of the electric field of the RF signal at microstrip output end 22. An electrically conductive ground pin 25 extending between the layers 14 and 16 through the substrate 12 provides RF continuity between the electrically conductive layers 14 and 16. The ground pin 25 is preferably positioned near the end 26 of the matching element 20 opposite microstrip output 22. The ground pin 25 ensures a good RF short between the electrically conductive layers 14 and 16 to facilitate efficient energy transfer from the microstrip 13 to the slotline 17.

Figure 3:
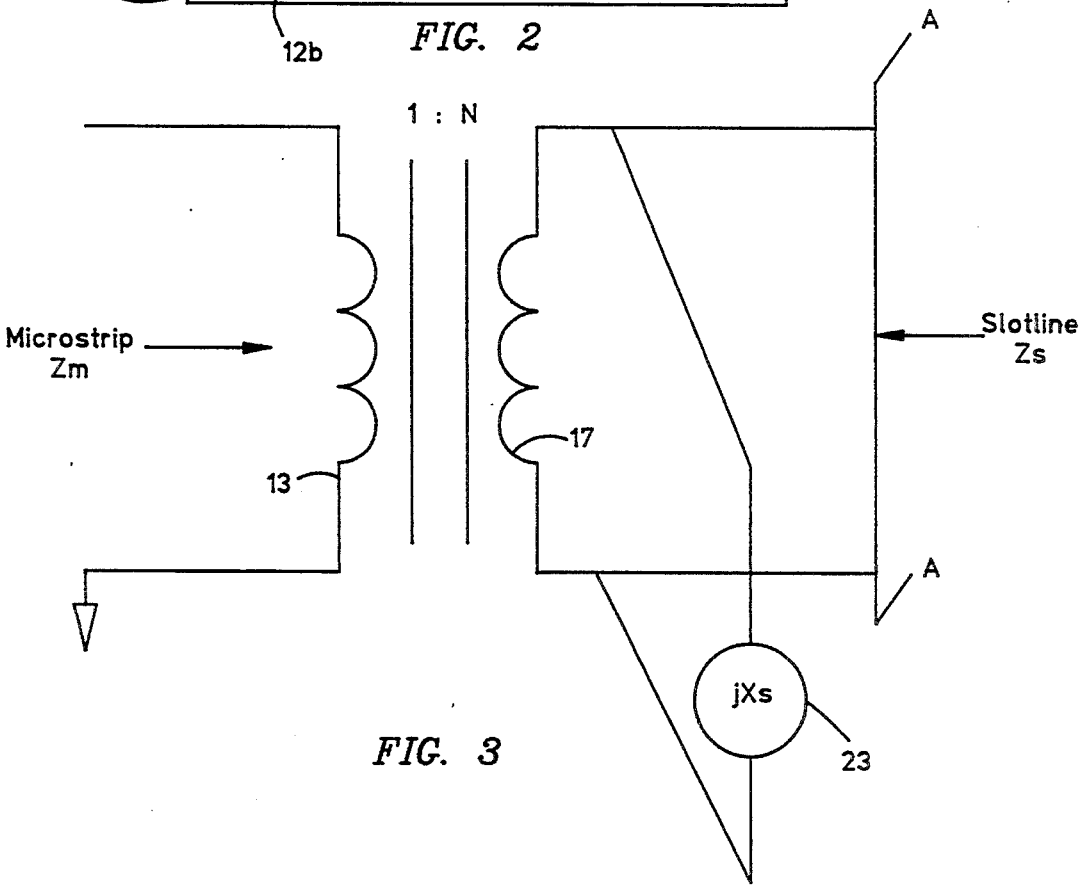
FIG. 3 is an electrical schematic representation of the uniplanar microstrip to slotline transition of FIG. 1.

An electrical schematic representation of MST 10 is provided in FIG. 3 in which the matching element 20 is represented as a matching element 23 having reactance $jX_s$ which establishes the impedance transformation from a microstrip transmission mode to a slotline transmission mode.

Figure 4:
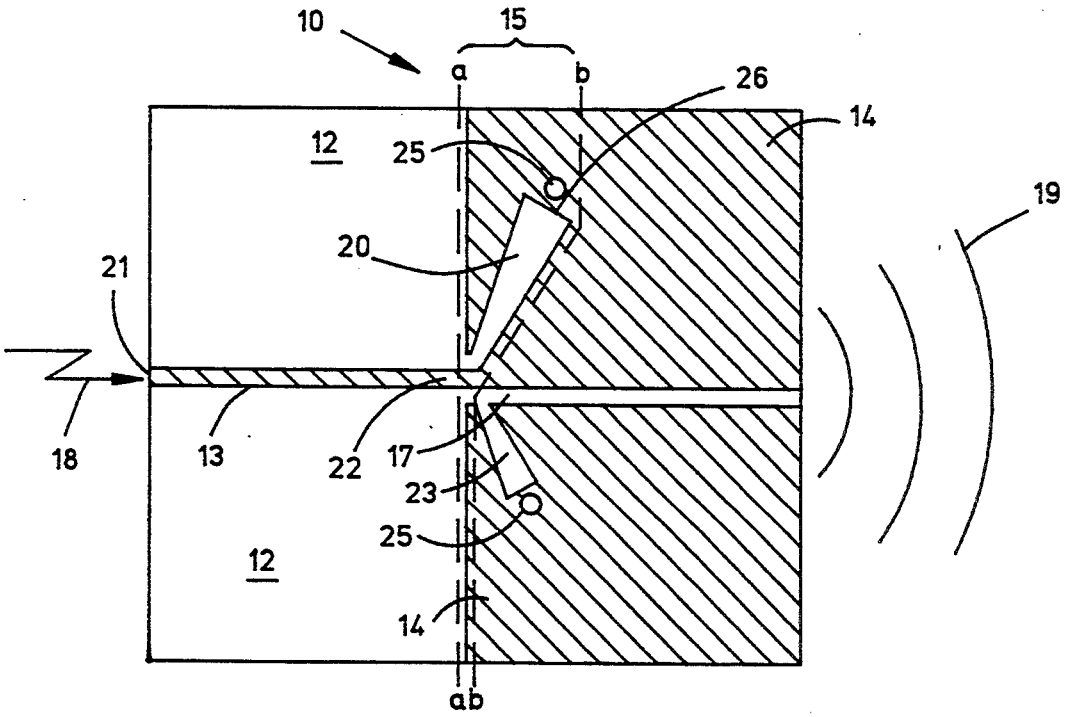
FIG. 4 is a plan view of a uniplanar microstrip to slotline transition embodying various features of the present invention which includes two matching elements.

In some applications, as shown in FIG. 4, MST 10 may include two matching elements, such as opposed matching elements 20 and 23 about slotline 17. Multiple matching elements may be employed to tailor the RF tuning performance of MST 10, especially if resonant devices are RF coupled to the slotline 17. The matching elements may be symmetrical or non-symmetrical, depending on the requirements of a particular application. In yet another embodiment of the present invention, MST 10 may have three matching elements, as for example, matching element 20, and opposed matching elements 27 about the slotline 17, as shown in FIG. 5.

Figure 6:
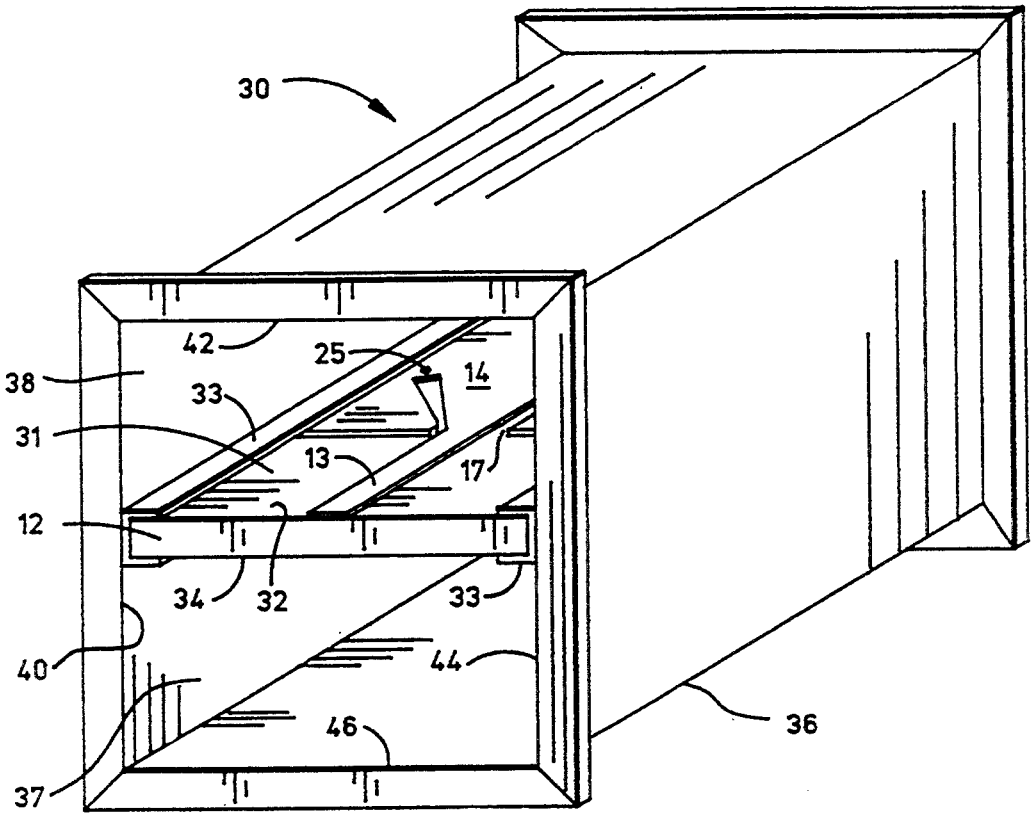
FIG. 6 is a perspective view of a microstrip line to waveguide transition which includes a microstrip to slotline transition embodying various features of the present invention.

In an example of one particular application of the invention, described with reference to FIG. 6, there is shown a microstrip to slotline transition ("MST") 31 embodying various features of the present invention mounted within a waveguide 36 to create a microstrip line to waveguide transition 30. The waveguide 36 functions as a high pass filter satisfying the relation: $f_{wg} < f_{mst}$, where $f_{wg}$ represents the minimum RF frequency which may be propagated through the waveguide 36, and $f_{mst}$ represents the RF frequency transmissible by MST 31.

Figure 7:
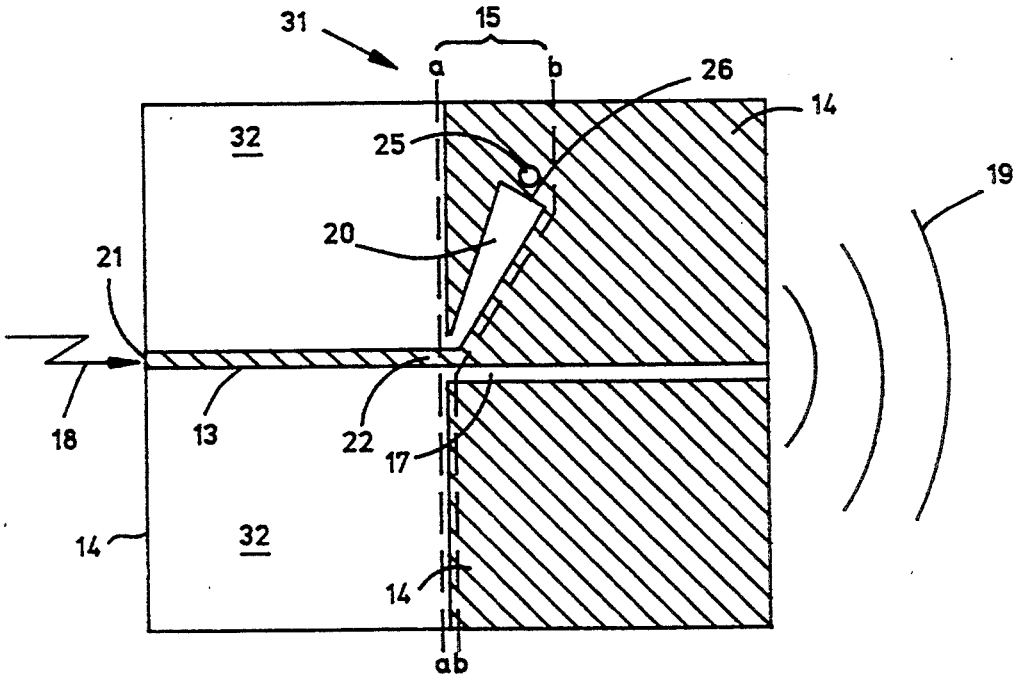
FIG. 7 is a plan view of the microstrip to slotline transition shown in the microstrip line to waveguide transition of FIG. 6.

By way of example, MST 31 may be configured as shown in FIG. 7 to include a microstrip 13, transition 15, and slotline 17. The plan view of MST 31 as shown in FIG. 7 looks exactly like that of MST 10 shown in FIG. 1. However, as more clearly illustrated in FIG. 6, MST 31 does not necessarily have a ground plane joined to the bottom surface of the substrate 12. Rather, MST 31 is constructed to have a substrate 12 having opposed planar surfaces 32 and 34. An electrically conductive and preferably monolithic layer 14 is joined to the planar surface 32.

The waveguide 36 is preferably formed of a sheet metal housing preferably having a rectangular prismatic interior channel 38 defined by sides 40, 42, 44, and 46, where side 42 opposes surface 32 of the substrate 12, and is parallel to surface 46. MST 31 is shown mounted within the housing and supported by opposed metal channel supports 33 which are attached to sides 40 and 44 in accordance with well known microwave integrated circuit fabrication techniques. MST 31 is positioned within the waveguide 36 so that there is: 1) an air gap formed between the planar surface 34 of substrate 12 and the surface 46 which forms a channel 37, thereby providing MST 31 with a suspended ground plane; and 2) an air gap between surface 32 of substrate 12 and surface 42 which forms the channel 38. Further, MST 31 is held by and between channel supports 33 so that the regions of electrically conductive layer 14 which comprise the slotline 17 are in direct current ("DC") contact with opposed sides 40 and 44 of the waveguide 36.

Figure 8:
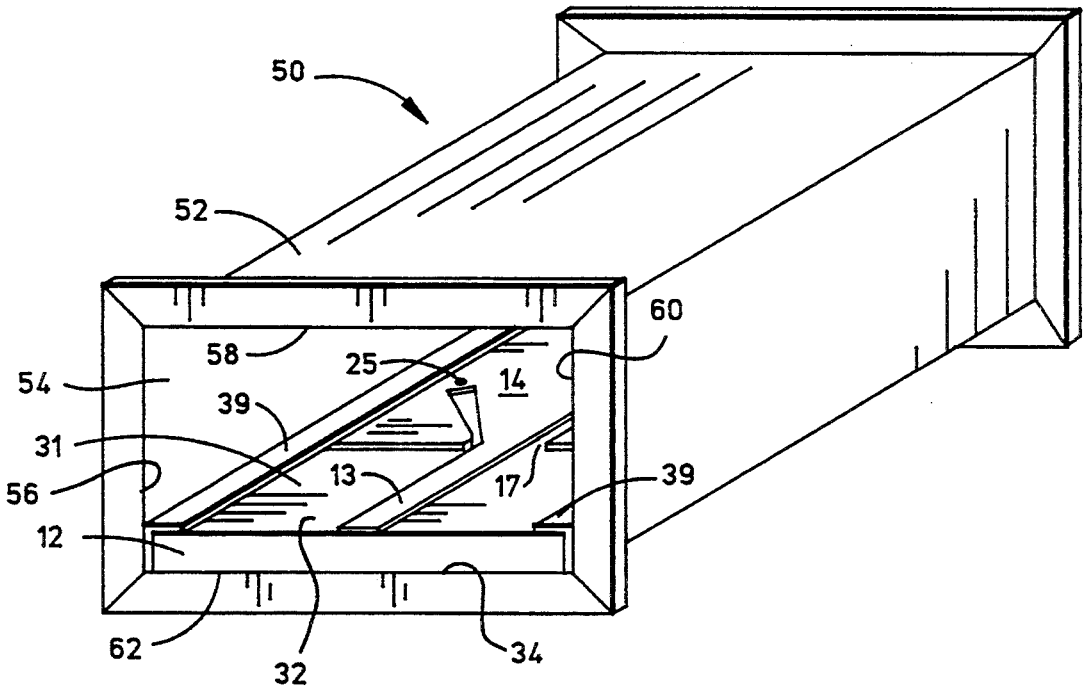
FIG. 8 is a perspective view of a shielded microstrip line to waveguide transition embodying various features of the present invention.

In another application of the invention, described with reference to FIG. 8, there is shown microstrip line to slotline transition ("MST") 31 mounted within a preferably sheet metal housing 52 to create a shielded microstrip line to slotline transition 50. The dimensions of housing 52 are chosen in accordance with well known techniques so that the cut-off frequency of the housing 52 is greater than that of MST 10, satisfying the relation: $f_{sh} > f_{mst}$, where $f_{sh}$ represents the RF cutoff frequency of the housing 52, and $f_{mst}$ represents the RF frequency transmissible by MST 31. Cutoff frequency refers to a frequency below which the housing 52 will not propagate an RF signal in a waveguide mode.

The housing 52 is preferably formed of a sheet metal and is configured to preferably have a rectangular prismatic interior channel 54 defined by sides 56, 58, 60, and 62, in which side 58 is substantially parallel to side 62. MST 31 is shown mounted within opposed metal angle brackets 39 mounted to sides 56 and 60 so that: 1) the regions of electrically conductive layer 14 comprising slotline 17 are in electrical contact with the housing; 2) the bottom surface 34 of the substrate 12 is generally coterminous and substantially adjacent to the surface 62 of the housing; and 3) an air gap is formed between electrically conductive layer 14 on the surface 32 of substrate 12 and side 58 of housing 52, thereby defining a channel 54.

Obviously, many modifications and variations of the present invention are possible in light of the above teachings. It is therefore to be understood that within the scope of the appended claims, the invention may be practiced otherwise than as specifically described.

We claim:

1. A uniplanar microstrip transmission line to slot transmission line transition, comprising:

a substrate having opposed first and second sides, said substrate composed of a material selected from the group consisting of electrically insulating materials and semiconducting materials;

a first electrically conductive layer joined to said first side of said substrate to form a groundplane;

a second electrically conductive layer having first and second coterminous regions joined to said second side of said substrate so that said first electrically conductive layer and said first region of said second electrically conductive layer constitute a microstrip line; and a third electrically conductive layer joined to said second side of said substrate and separated from said first and second regions of said second electrically conductive layer, said first, second and third electrically conductive layers constitute a microstrip line to slotline transition having a matching element, and a slotline.

2. The uniplanar microstrip transmission line to slot transmission line transition of claim 1 further including a ground pin electrically coupling said first electrically conductive layer to said second electrically conductive layer through said substrate.

3. The uniplanar microstrip transmission line to slot transmission line transition of claim 1 wherein said matching element has a generally circular shape.

4. The uniplanar microstrip transmission line to slot transmission line transition of claim 1 wherein said matching element has a generally triangular shape.

5. The uniplanar microstrip transmission line to slot transmission line transition of claim 1 wherein said matching element is shaped as a generally rectangular slot.

6. The uniplanar microstrip transmission line to slot transmission line transition of claim 1 wherein said matching element has a generally elliptical shape.

7. The uniplanar microstrip transmission line to slot transmission line transition of claim 1 wherein said matching element is shaped as a polygon.

8. The uniplanar microstrip transmission line to slot transmission line transition of claim 1 wherein said first and second electrically conductive layers are composed of a material selected from the group consisting of copper, aluminum, electrically conductive polymer, and a superconductor.

9. The uniplanar microstrip transmission line to slot transmission line transition of claim 1 wherein said electrically insulating materials consist of the group consisting of plastic, ceramic, quartz, and alumina, and said semiconducting materials include materials from of the group consisting of Group III, Group IV, and Group V semiconductors.

10. The uniplanar microstrip transmission line to slot transmission line transition of claim 1 wherein said matching element and said slotline are formed by exposing first and second regions, respectively, of said substrate through said second electrically conductive layer.

11. A shielded microstrip transmission line to slotline transition, comprising:

a metal housing having first and second parallel sides which define a channel, said first side providing a ground plane; and a uniplanar microstrip line to slotline transition having:

a substrate having opposed first and second surfaces which is mounted within said channel so that said first surface is substantially adjacent to and coterminous with respect to said first side of said metal housing, said substrate composed of a material selected from the group consisting of electrically insulating materials and semiconducting materials; and a first electrically conductive layer joined to said second surface of said substrate, said first side of said metal housing and a region of said first electrically conductive layer constituting a microstrip line; and a second electrically conductive layer joined to said second surface of said substrate and separated from said first electrically conductive layer so that said first side of said metal housing and said first and second electrically conductive layers constitute a microstrip line to slotline transition having a matching element, and a slotline in electrical contact with said housing; and said substrate is positioned within said channel so as to form an air gap between said electrically conductive layer and said second side of said housing.

12. A microstrip line to waveguide transition, comprising:

a metal housing having a first side parallel to a second side which define a channel; and a uniplanar microstrip line to slotline transition having:

a substrate having opposed first and second surfaces which is mounted within said channel, said substrate composed of a material selected from the group consisting of electrically insulating materials and semiconducting materials;

a first electrically conductive layer joined to said first surface of said substrate, a region of said first electrically conductive layer and said first side of said metal housing constituting a microstrip line having a suspended ground plane; and a second electrically conductive layer joined to said first surface of said substrate and separated from said first electrically conductive layer so that said first and second electrically conductive layers and said first side of said metal housing constitute a microstrip transmission mode to slotline transmission mode transition having a matching element and said suspended ground plane, and a slotline in electrical contact with said housing having said suspended ground plane, and said substrate is mounted within said housing so that a first air gap is formed between said first electrically conductive layer and said first side of said housing, and a second air gap is formed between said second electrically conductive layer and said second side of said housing.

* * * * *